United States Patent [19]

Sachleben, Sr. et al.

[11] 3,933,319

[45] Jan. 20, 1976

[54] VERTICAL SPINDLE WINDER

[75] Inventors: Harold Gerard Sachleben, Sr., Bellmawr, N.J.; Everett Gray Montgomery, Chester, Va.; Clarence Albert Forman; Robert David Carr, both of Hopewell, Va.; Lawrence Edward Cary, Richmond, Va.; Beryl Aaron Boggs, Chesterfield, Va.; Harold George Burnley, Jr., Chester, Va.; Alistair James Chafer, Greenock-Renfrewshire, Scotland

[73] Assignee: Allied Chemical Corporation, Petersburg, Va.

[22] Filed: Apr. 9, 1974

[21] Appl. No.: 459,429

[52] U.S. Cl. ..... 242/18 R; 242/26; 252/43 R

[51] Int. Cl.[2] ..... B65H 54/06; B65H 54/30

[58] Field of Search ..... 242/18 R, 18 DD, 25 R, 242/26, 26.1, 26.2, 35.5 R, 43

[56] References Cited

UNITED STATES PATENTS

| | | | |
|---|---|---|---|
| 707,684 | 8/1902 | Fay et al. | 242/26 |
| 2,284,730 | 6/1942 | Elvin et al. | 242/18 R |
| 2,524,623 | 10/1950 | Colombu | 242/43 UX |
| 2,649,254 | 8/1953 | Balthrop, Jr. | 242/43 |
| 2,965,322 | 12/1960 | Wiering | 242/18 R |
| 3,281,086 | 10/1966 | Goodman et al. | 242/43 X |
| 3,350,021 | 10/1967 | Marciniak | 242/18 R |
| 3,779,472 | 12/1973 | Boggs | 242/18 DD |

FOREIGN PATENTS OR APPLICATIONS

| | | | |
|---|---|---|---|
| 712,257 | 7/1954 | United Kingdom | 242/43 |

*Primary Examiner*—Stanley N. Gilreath
*Attorney, Agent, or Firm*—Richard A. Anderson

[57] ABSTRACT

The prior art apparatus to wind vertically running yarn was a vertical spindle with a pulley mounted on a driven shaft, a stationary yarn wheel guide, an upper vertically movable yarn guide wheel, a lower vertically movable yarn guide wheel, a double track cam vertically mounted with a driven pulley and shaft, an upper cam follower and shoe, a lower cam follower and shoe, cam housing having a vertical slot, a motor having both a spindle drive pulley and a cam drive pulley mounted on a drive shaft, a belt to drive the spindle from the motor and a belt to drive the cam from the motor. The motor would drive the vertical spindle and the cam by the connection of the driven pulleys to the motor drive pulleys with belts. The vertically movable yarn guide wheels were connected to their respective cam followers and the cam followers were both driven by this one double track cam to oscillate vertically in the cam housing slot. In this manner, the upper vertically movable yarn guide wheel oscillates in the upper half of the housing slot and the lower vertically movable guide wheel oscillates nearly the full length of the housing slot and for the full traverse of the winding yarn. The movable guide wheels, in concert, maintain a constant length of yarn between the stationary yarn wheel and the spindle. The stationary yarn wheel is centered with respect to the length of yarn traverse wound onto the vertical spindle. The improvement comprises a two-speed transmission used to drive the cam at two winds, and a high speed double track cam with the tracks cut so that the cam followers will describe a path at reversal along a 60° angular displacement of a curve of cycloidal development. Thus, the spindle and the cam can start at a wind of from about 89 to about 152.52 and after about 0.1 to about 3 minutes, then change to achieve a wind of from about 11 to about 17. Yarn wound up in this manner can be unwound of speeds of up to 3,000 feet per minute or higher, for processing at speeds up to 8,000 feet per minute.

6 Claims, 13 Drawing Figures

VERTICAL SPINDLE WINDER

BACKGROUND OF THE INVENTION

This invention relates to a vertical spindle winder, more particularly, apparatus to wind vertically running yarn such as freshly spun yarn descending from a spinning stack.

It is known to wind vertically running yarn from any source above the winder as a continuous running length of yarn with a vertical spindle having a pulley mounted on a driven shaft, a stationary wheel yarn guide, an upper vertically movable yarn guide wheel, a lower vertically movable yarn guide wheel, a double track cam being vertically mounted with driven pulley and shaft, an upper cam follower and shoe, lower cam follower and shoe, a cam housing having a vertical slot, a motor having a spindle drive pulley and a cam drive pulley mounted on the drive shaft, a belt to drive the spindle from the motor and a belt to drive the cam from the motor. The motor drives the vertical spindle and the cam by a connection of the driven pulleys to the drive pulleys with the belts. The vertically movable yarn guide wheels are connected to their respective cam followers and shoes and the cam followers are both driven by the one double track cam to oscillate vertically in the cam housing slot in such a manner that the upper vertically movable yarn guide wheel oscillates only in the upper half of the slot; the lower vertically movable yarn guide wheel oscillates nearly the full length of the slot but for the full traverse of the winding yarn at twice the speed of the upper wheel so that the movable guide wheels acting in concert maintain a constant length of yarn between the stationary yarn wheel, and the spindle. The stationary wheel is centered with respect to the length of the yarn traverse as it is wound onto the vertical spindle.

The double track cam is cut so that the upper cam track is in the upper half of the cylinder and the cam track for the lower yarn wheel guide is cut nearly the full length of the cylinder. This lower cam track stops short of the top of the traverse of the upper cam track so that the two yarn wheel guides do not collide at the top of their oscillating motion or traverse. They both must reach the top of their traverse at the same time to accomplish the constant yarn length of this invention.

Packages of up to 95 pounds or more of yarn from any source above the vertical spindle as a running continuous length of yarn can be made. The yarn passes over the stationary wheel guide, over the upper vertical movable yarn guide wheel and then over the lower vertically movable yarn guide wheel, both mounted on brackets in the vertical slot in the cam housing. They traverse the yarn as described above. The spindle is rotated to wind up the yarn at a constant take-up speed. In the prior art, there were three major obstacles to the success of such a winder: (1) a wind suitable for both start-up right after string-up of the yarn on the winder was not suitable for winding the yarn at a standard operating condition, and vice versa, (2) cams and cam followers and shoes would break at the high speeds of the reversal points in the cam tracks, and (3) brackets of the movable yarn guide wheels which held them to the cam followers also broke at the high speeds at the reversal points.

SUMMARY OF THE INVENTION

By using a two-speed transmission driven by the single drive motor used to drive both the double track cam and the yarn spindle, the cam in turn driving the traversing yarn wheel guides; two winds could be achieved to drive the spindle and the traverse mechanism starting at a wind of from about 89 to about 152.52, preferably 152.51366, and after about 0.1 to about 3 minutes changing to achieve a wind of from about 11 to about 17, preferably 15.96380 with a lay of 0.1342 inches and helix angle of 9°42′ to 4°35′. The problem was partly solved. Then using a high speed double track cam with the two tracks cut so that the cam follower will describe a path at the reversal along a 60° angular displacement of a curve of cycloidal development was added. In addition, a substantial bracket with at least the lower bracket being pivotally mounted was used. With these improvements, the problems described in the background were overcome and wound yarn could be unwound at speeds of up to 3,000 feet per minute for processing up to 8,000 feet per minute. Preferably, the high speed cam is made of an acetal resin. The upper vertically movable yarn guide is preferably mounted on a fixed bracket and the lower vertically movable yarn guide is preferably mounted on a swingably mounted bracket.

By double track cam is meant two cam tracks both cut on the same cylinder and each of which can have a track for a follower and a track for a shoe. By "wind" is meant the number of the spindle revolutions per traverse of the yarn between the flanges of the spindle. The wind ratio would be double this. By "helix angle" is meant the angle between the actual yarn lay down path and a line parallel to the flange. By "lay" is meant the distance between the new yarn end and the previous end when the traverse guide and spindle return to their original position.

Although this description is directed to a vertical yarn source and a vertical spindle winder, the invention could easily be adapted to horizontal, or other angle, yarn source and horizontal, or other angle, mounting of the spindle and resulting change of orientation of all other elements by simple, expedient changes well known to those skilled in the art.

DESCRIPTION OF THE PREFERRED EMBODIMENTS

Figure 2:
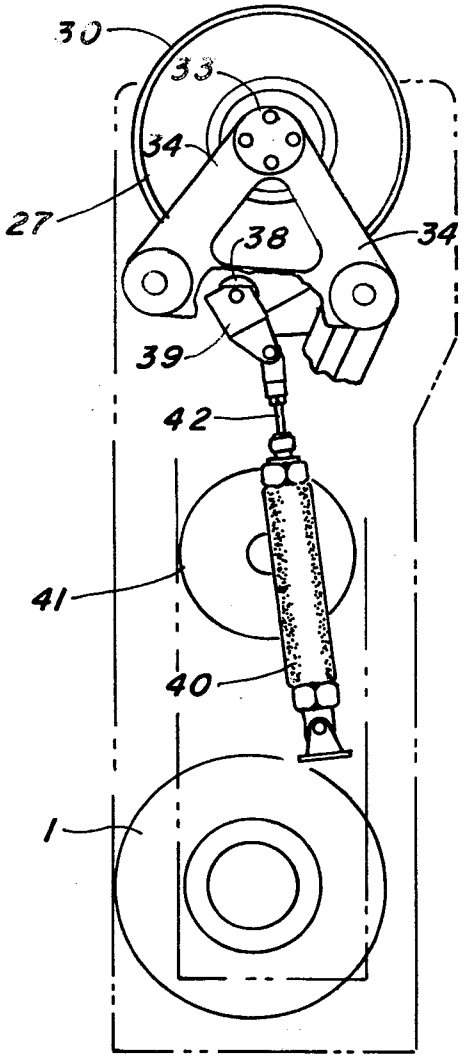
FIG. 2 is a plan view of the winder of this invention.

The preferred embodiment is shown in the drawings and will be described below.

Figure 1:
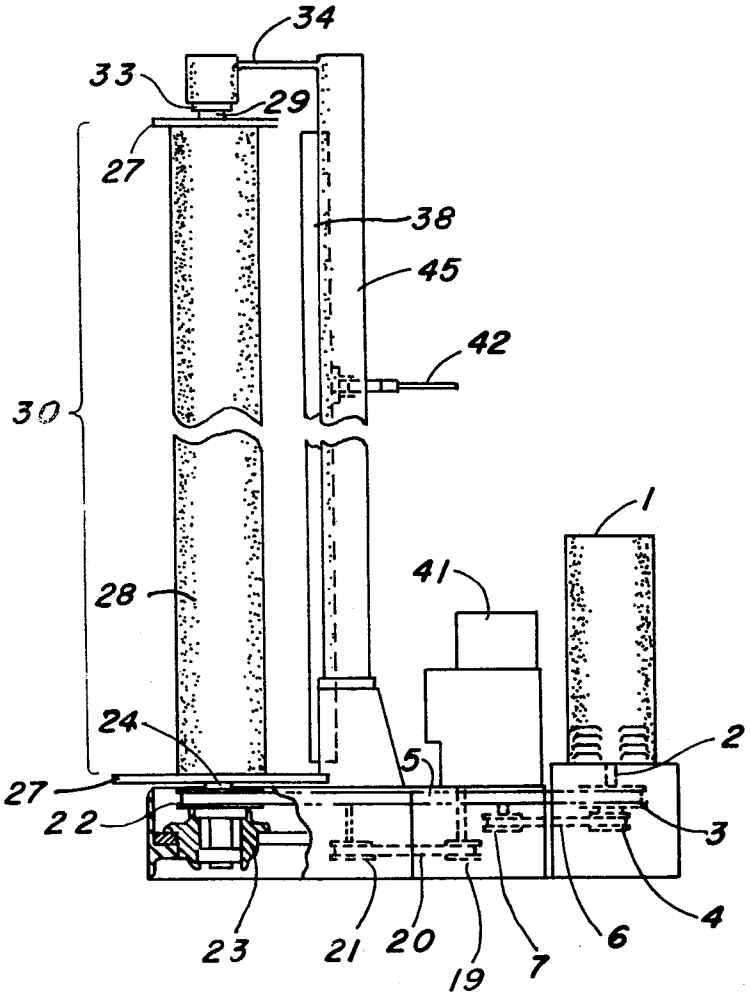
FIG. 1 is a schematic elevation view of the improved vertical spindle winder of this invention.

FIG. 1 is a schematic elevation showing the major portions of the winder. Electric motor 1 with shaft 2 having spindle drive pulley 3 and transmission drive pulley 4 mounted thereon is connected by spindle drive belt 5 and transmission drive belt 6 to spindle pulley 22 and transmission pulley 7. Other connecting means such as chains or direct drive gears could be used. Power moves through the transmission in transmission housing 41 to transmission pulley 19 connected with traverse drive belt 20 to traverse pulley 21 which drives the cam 50, shown in FIG. 4. Vertical spindle 30 is mounted on stub shaft 24 at the bottom, and at the top into spindle engaging receiver 29. It rotates on bearings 23 and bearings in bearing housing 33 and is held in place by spindle mounting bracket 34. Vertical spindle 30 is made up of hub 28 and flanges 27. Cam housing 45 and presser roll 38 are also shown in position vertically along the length of vertical spindle 30. Presser roll 38 presses upon the package of yarn as it is being wound to maintain it cylindrical and compact.

FIG. 2 is a plan view of the vertical spindle winder showing motor 1, transmission housing 41, vertical spindle 30, spindle flange 27, bearing housing 33, and spindle mounting bracket 34. The freshly wound package is kept cylindrical and compact by presser roll 38 which extends the full length of spindle 30 and is held in position by bracket 39. In operation pressure is transmitted from pneumatic cylinder 40, which is pivotally mounted on the winder frame, through rod 42 to bracket 39.

Figure 3:
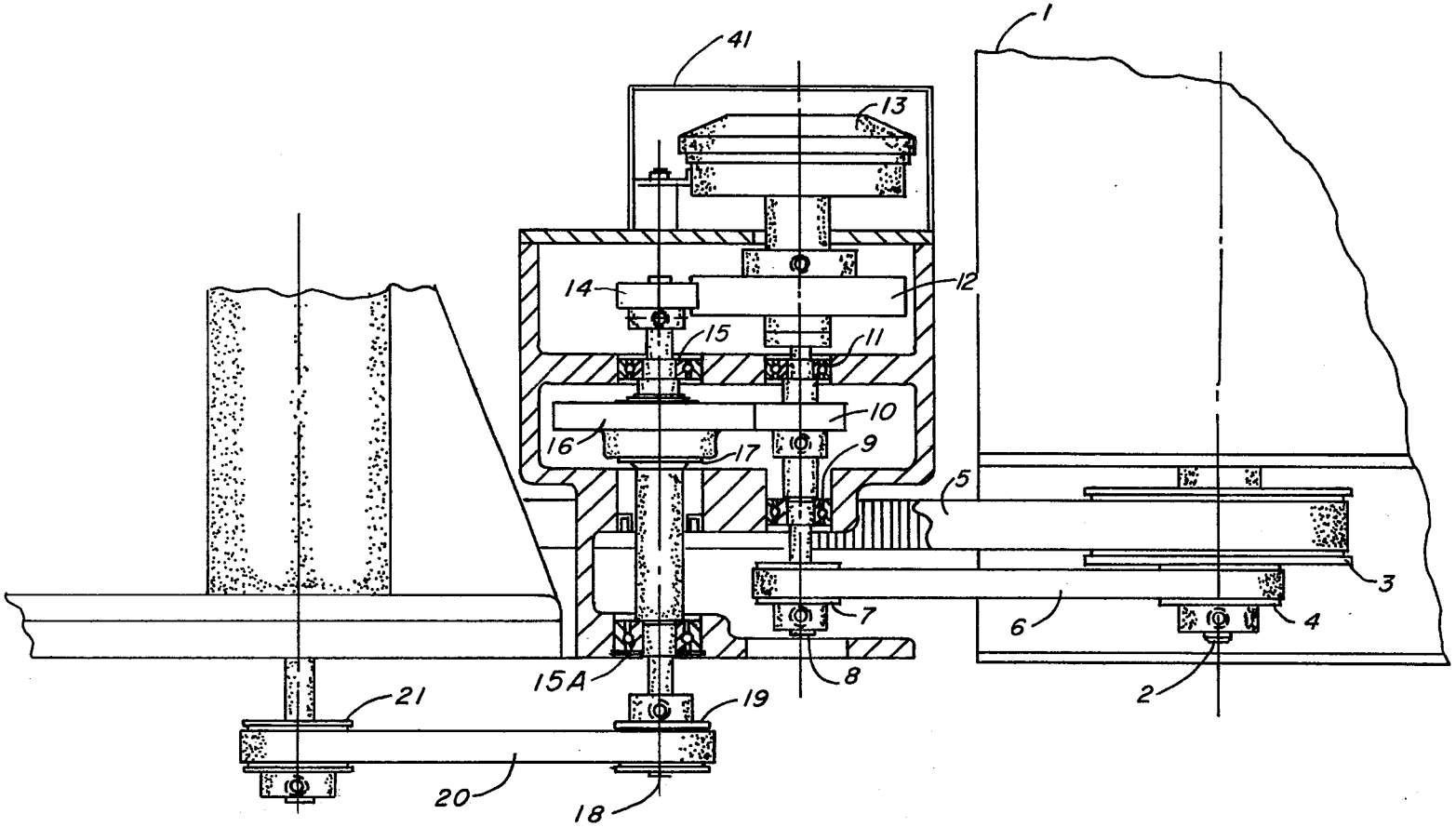
FIG. 3 is a cross sectional elevation view of the two-speed transmission used in this invention.

FIG. 3 is an elevational cross-sectional view of the two-speed transmission in transmission housing 41. This figure shows motor 1 with spindle drive pulley 3 and transmission drive pulley 4 mounted on motor shaft 2 and transmitting power through spindle drive belt 5 and transmission drive belt 6. Transmission pulley 7 is driven by belt 6 to turn transmission shaft 8 in bearings 9 and 11 to continuously rotate slow speed gear 10 and high speed gear 12. Shaft 8 is also directly connected to magnetic clutch 13 which can be any standard magnetic clutch available on the market. Transmission shaft 18 is driven at two speeds to transmit power through transmission pulley 19 and belt 20 to traverse pulley 21 which drives cam 50, shown in FIG. 4. Two speeds are achieved as follows: For the startup mode, magnetic clutch 13 is disengaged so that high speed gears 12 and 14 freewheel, and power is transmitted through low speed gear 10 to mating gear 16 and then to shaft 18 rotating in bearings 15 and 15A. High speed mode is adapted by engaging magnetic clutch 13 and overriding slow speed gears 10 and 16 so that they freewheel due to an overriding clutch 17 which disengages. Thus, in this mode, power flows from shaft 8 through high speed gears 12 and 14 to shaft 18.

Figure 4:
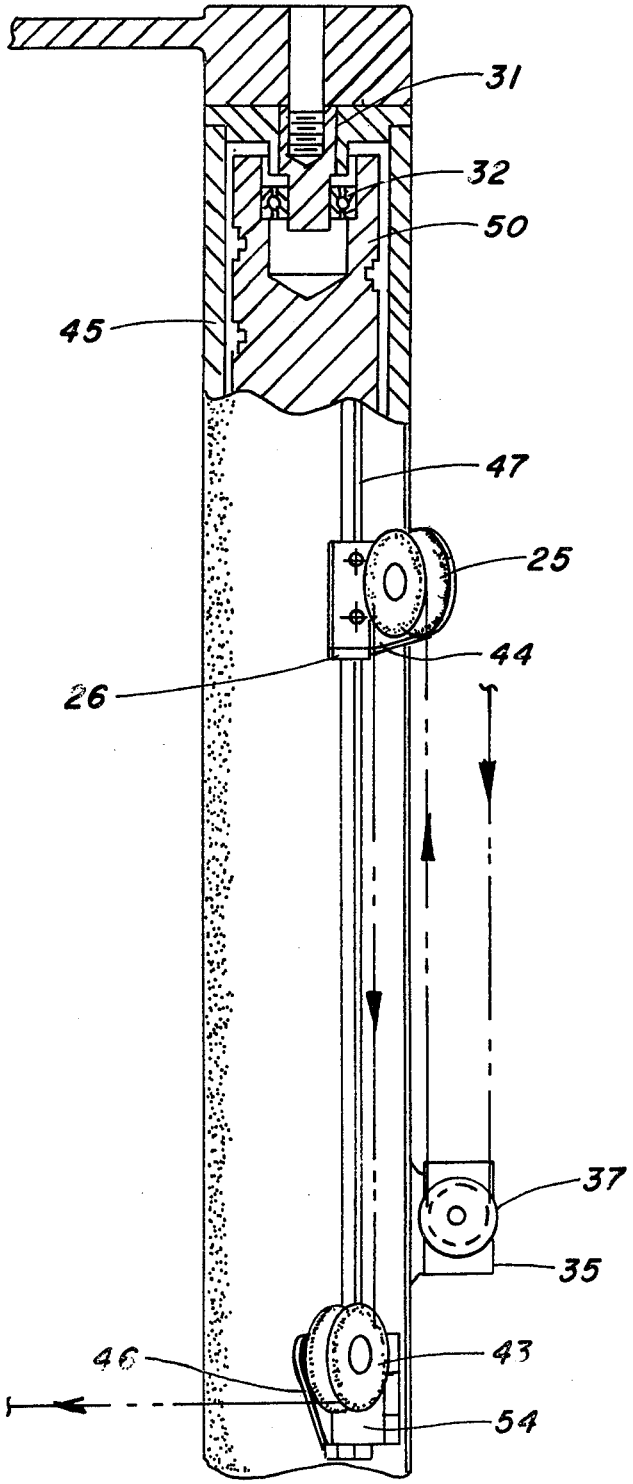
FIG. 4 is an elevation partial cross-section showing the traverse mechanism of this invention.

FIG. 4 is a partial cross section elevation view of the traverse mechanism. Cam 50 is driven by a shaft connected to traverse pulley 21 shown in FIGS. 1 and 3. Cam 50 is a double track cam which drives both upper yarn guide wheel 25 and lower yarn guide wheel 43. These guides and the stationary guide wheel can be standard ceramic slot guides or other well known guides. The downcoming yarn shown by the arrows in the Figure first passes over stationary yarn guide wheel 37, then over upper vertically movable yarn guide wheel 25, then over lower vertically movable yarn guide wheel 43, and then to traverse across the length of spindle 30 to be wound. Upper yarn guide wheel 25 is connected by means of bracket 44 to slot follower 26 which oscillates in the slot 47 in cam housing 45. Cam 50 rotates around stub shaft 31 on cam bearing 32. Stationary yarn guide wheel 37 is mounted in pin support 35. Lower yarn guide wheel 43 is mounted on bracket 46 which is in turn attached by means of a bolt to plate 54 which hides the lower slot follower shown on FIG. 7. By the means of the traverse mechanism shown in FIG. 4 the two vertical oscillating yarn wheel guides 25 and 43 are driven by the double track cam in such a manner that the upper yarn wheel guide 25 operates in the upper half of the slot 47 and the lower yarn wheel guide 43 operates across nearly full length of slot 47. The upper yarn wheel guide 25 moves at one-half speed of the full traverse yarn wheel guide 43. Acting in concert, these wheels maintain a constant length of yarn between stationary yarn wheel guide 37 and the point where the yarn contacts spindle 30 as it is being wound.

Figure 5:
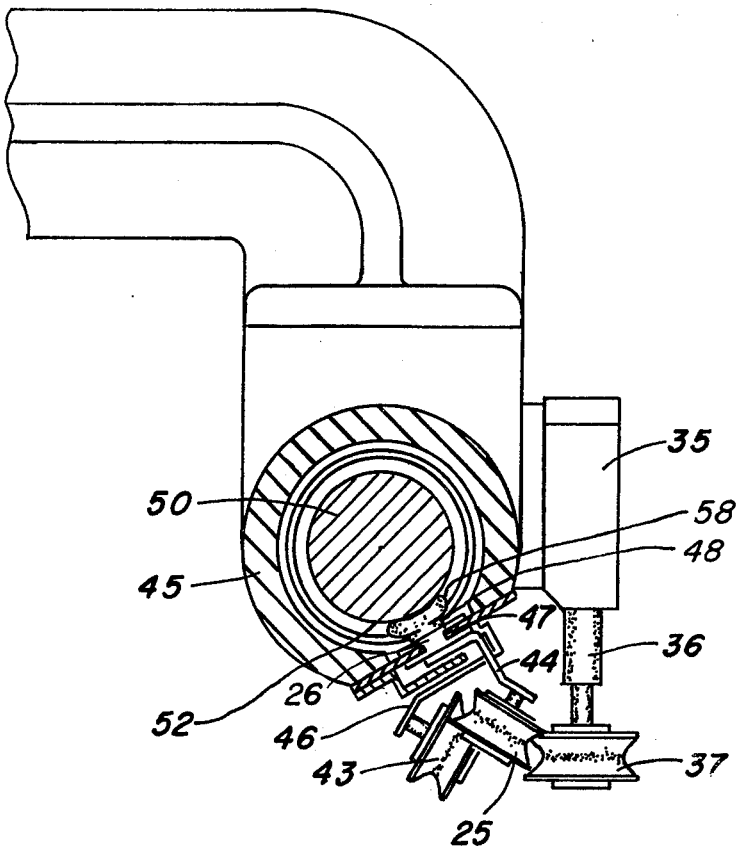
FIG. 5 is a plan view with partial cross-section of the traverse mechanism of this invention.

FIG. 5 is a plan view showing traverse mechanism in cross section, i.e., is a plan view of FIG. 4. Stationary yarn wheel guide 37 is mounted on pin 36 which is supported by pin support 35. Upper yarn wheel guide 25 is mounted on bracket 44 which in turn is mounted on slot follower 26 which has rotatably connected cam follower 48 and shoe 58 attached to it. Thus, as double track cam 50 rotates, cam follower 48 and shoe 58 are driven up and down the track 52 in double track cam 50 to actuate slot follower 26 in slot 47 thereby oscillating yarn guide wheel 25 and bracket 44. Similarly, lower yarn guide wheel 43 is mounted on pivotally mounted bracket 46 which is in turn mounted on slot follower 53 (shown in FIG. 7) connected to the rotatably mounted cam follower 49 and shoe 59, shown in FIG. 7. Cam housing 45 is shown and the cam track 52 for the upper half of slot 47 is shown contacting upper cam follower 48 and shoe 58.

Figure 6:
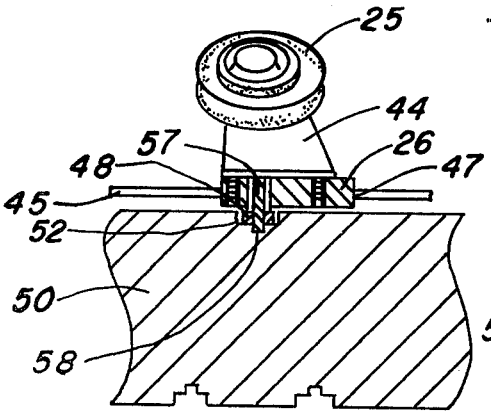
FIG. 6 is a partial cross-section showing details of the mounting of the upper yarn guide wheel.

FIG. 6 is a cross sectional view showing how upper yarn guide wheel 25 is mounted and driven by double track cam 50. Upper half cam track 52 is followed by upper cam follower 48 and shoe 58 which are rotatably connected to follower 26 by means of bolt or pin 57. Upper yarn guide wheel 25 is attached to bracket 44 which is rigidly attached to slot follower 26. Slot follower 26 oscillates vertically up and down in slot 47 in cam housing 45, half the length of the slot 47, since cam track 52 is cut for that length.

Figure 7:
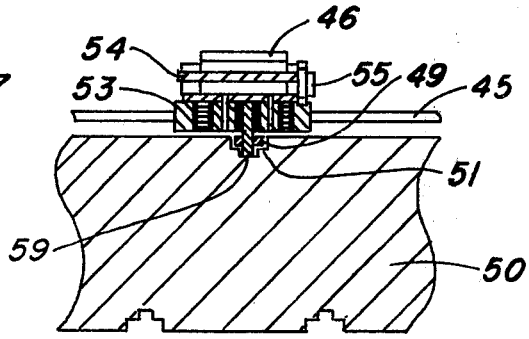
FIG. 7 is a similar partial cross-section view showing details of the lower yarn guide wheel.

FIG. 7 is a sectional view showing how lower yarn guide wheel 43 is similarly actuated by double track cam 50. Full length cam track 51 is followed by lower cam follower 49 and shoe 59 which are rotatably mounted to slot follower 53 which is in turn attached to plate 54 which has receiving means for bolt or pin 55 to hold pivotally mounted bracket 46 which is attached to lower yarn guide wheel 43 as shown in FIG. 5. Lower cam follower 49 and shoe 59, slot follower 53, plate 54, bracket 46, and yarn guide wheel 25 oscillate at twice the speed of upper yarn guide wheel 25 for the full length of yarn traverse.

Figures 8, 9, 10, 11:
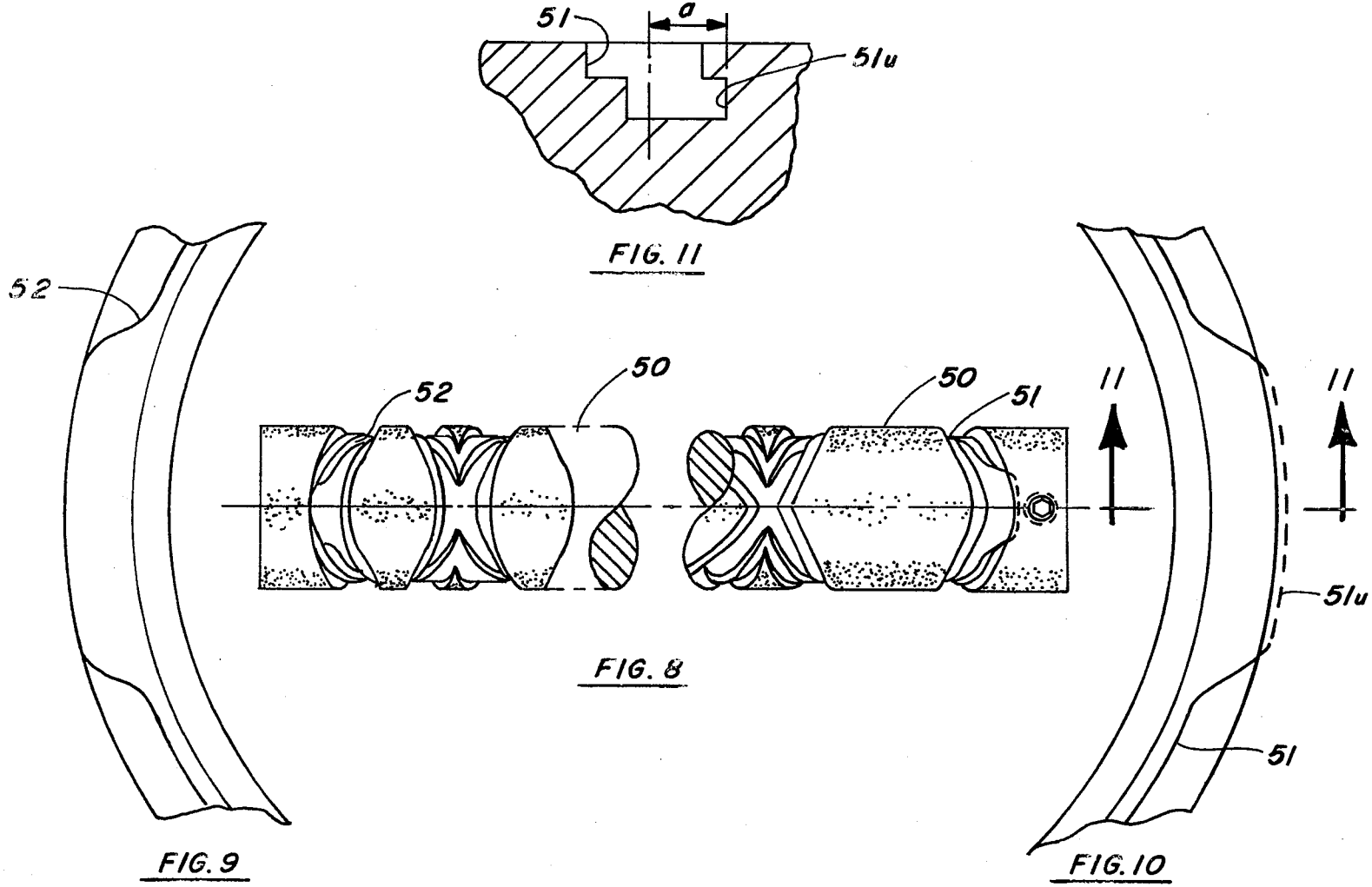
FIG. 8 is a view of the cam, partially cut away.
FIG. 9 is a detailed view of a reversal of a cam track used at the upper half of the housing slot.
FIG. 10 is a detail at the reversal of the cam track which runs nearly the full length of the housing slot.
FIG. 11 is section 11—11 on FIG. 10 across the reversal point of the full length the cam track showing the undercut.

FIG. 8 is a cut away view of double track cam 50 showing full length cam track 51 and upper half cam track 52.

FIG. 9 and FIG. 10 show more detail of the reversals of tracks 51 and 52. Full length track 51 must be undercut at the reversal point as shown in 51*u* so that the shoe 59 does not slam into the end bottom portion of slot 51 at the reversal point. Also, the method of cutting slots 51 and 52 is critical and must be cut so that the cam followers and shoes will describe a path at the reversal along a 60° angular displacement of a curve of cycloidal development.

Figure 12:
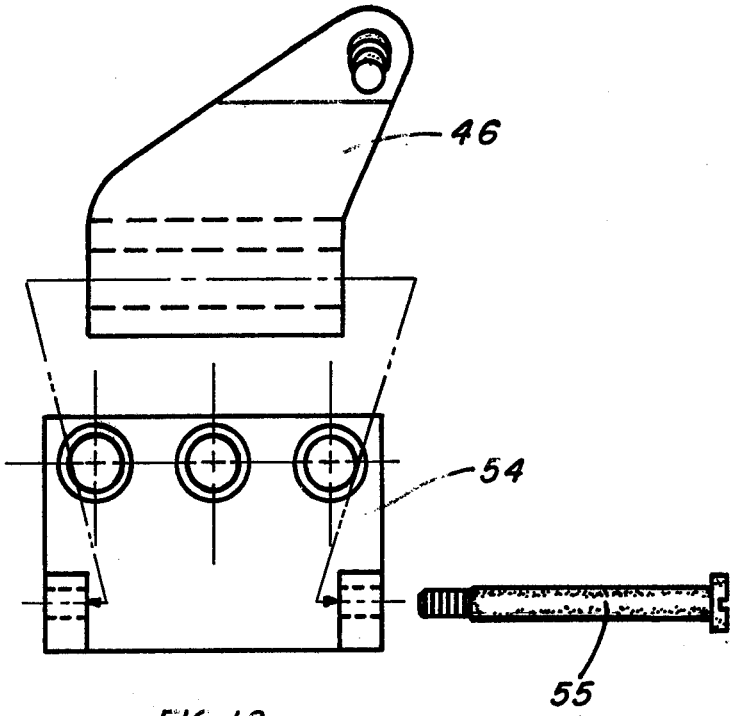
FIG. 12 is an exploded assembly drawing of the pivoted bracket mounting for the lower yarn guide wheel.

FIG. 12 shows the assembly of the pivoted lower yarn wheel guide bracket 46 which is attached to plate 54 by means of bolt or pin 55.

Figure 13:
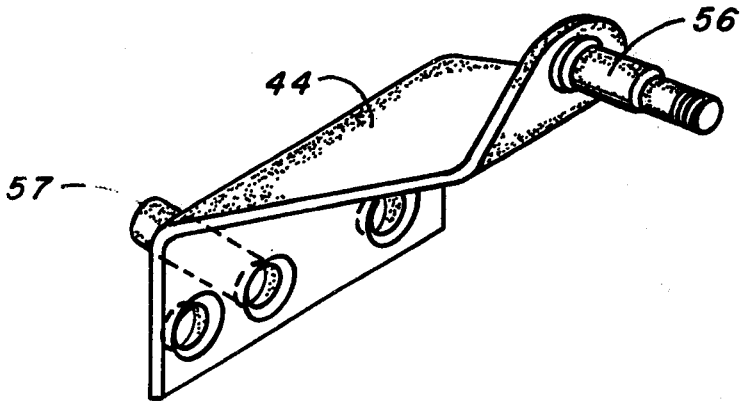
FIG. 13 shows the mounting bracket for the upper yarn guide wheel.

FIG. 13 shows upper yarn wheel guide bracket 44 with pin 56 for upper yarn wheel guide 25 to be mounted upon, and pin 57 for extending through slot follower 26 to mount upper cam follower 48, and shoe 58.

Example

The vertical spindle winder of this invention was used to take-up freshly spun nylon 6 having an undrawn denier of about 3200 at about 2,000 feet per minute. An 80 lb. wound package was prepared capable of being unwound at up to 3,000 feet per minute, i.e., ready for further processing at speeds up to 8,000 feet per minute. The winding parameters were those set forth below.

The pressure by the presser roll on the wound yarn was maintained at about 0.3 lbs. per lineal inch of presser roll. The target should be between 0.1 and 0.5 lbs/lineal inch and should vary by no more than 0.03 lbs./lineal inch.

Preferred wind is 152.51366 at start-up and 15.96380 after change, giving a lay of 0.1342 inches and a varying helix angle of from 9°42′ to 4°34′, after change.

The preferred curve of cycloidal development would be the curve described by the formula $$y = \left(\frac{h}{\pi}\right)\left[\frac{\pi\Theta}{\Theta_o} - \frac{1}{2}\sin\left(\frac{2\pi\Theta}{\Theta_o}\right)\right]$$

$y$ = rise of the follower above the base plane of the cycloidal curve in inches per angular displacement $\theta$ $h$ = maximum of follower rise in inches $\theta$ = cam angle rotation for follower displacement $y$ in radians $\theta_o$ = cam angle of rotation to give rise $h$ in radians

We claim:

1. In an apparatus to wind vertically running yarn comprising a vertical spindle with a driven pulley mounted on a shaft, a stationary yarn guide, an upper vertically movable yarn guide, a lower vertically movable yarn guide, a double track cam, vertically mounted with vertically attached driven pulley and shaft, an upper cam follower and shoe, a lower cam follower and shoe, a cam housing, vertically mounted and having a vertical slot, a motor having a spindle drive pulley and a cam drive pulley mounted on a drive shaft, connecting means to drive said spindle from said motor, connecting means to drive said cam from said motor, and a presser roll, vertically mounted along the length of said spindle said motor driving said vertical spindle and cam by connection of said driven pulleys to said drive pulleys with said connecting means, said vertically movable yarn guides connected to said respective cam followers and shoes through cam housing slot, said cam followers and shoes both driven by a respective cam track of said double track cam to oscillate vertically along said cam housing slot in such a manner that said upper vertically movable yarn guide oscillates only in the upper half of said slot at half the speed of the lower vertical movable yarn guide, and the lower vertically movable yarn guide oscillates nearly the full length of said slot and for the full traverse of the winding yarn, said movable guides acting in concert to maintain a constant length of yarn between the stationary yarn guide and the spindle, said stationary guide centered with respect to said vertical spindle, said presser roll holding said wound yarn in a cylindrical package during winding, the improvement comprising said connecting means to drive said cam including a two speed transmission to drive said cam at two winds, said high speed double track cam having tracks cut so that said cam followers will describe a path at the reversal along a 60° angular displacement of a curve of a cycloidal development so that said spindle and said cam can start at a wind of from about 89 to about 152.52 and after about 0.1 to about 3 minutes change to achieve a wind of about 11 to about 17 whereby said wound up yarn can be unwound at speeds up to 3,000 feet per minute.

2. The apparatus of claim 1 wherein said double track cam is made of an acetal resin.

3. The apparatus of claim 1 wherein said upper vertically movable yarn guide is mounted on a fixed bracket and said lower vertically movable yarn guide is mounted on a swingably mounted bracket.

4. The apparatus of claim 1 wherein said guides are wheels, and said connecting means include belts.

5. In a method to wind yarn on a vertical spindle into packages of yarn comprising passing yarn from any source above said spindle as a continuous running length over a stationary guide, over a vertically movable upper yarn guide mounted on a bracket and in a vertical slot and then over a lower vertically movable yarn guide also mounted on a bracket and in said slot, traversing said lower yarn guide the length of said vertically mounted spindle, rotating said spindle to wind up said yarn, driving said spindle by said motor to achieve a constant yarn takeup speed and driving each said yarn guides and brackets by a follower and shoe in a double track cam, also driving each said follower and shoe by said motor, said cam followers and shoes connected to said movable guides through said slot and said cam tracks cut so that said upper guide oscillates only in the upper half of said slot at half the speed of said lower guide, and the lower guide oscillates nearly the full length of said slot and for the full traverse of the winding yarn, said movable guides acting in concert to maintain a constant length of yarn between the stationary guide and the spindle, said stationary guide centered on said vertical spindle, said package shape being held cylindrical during winding by a presser roll, the improvement comprising driving said cam and said traversing yarn guides with a two-speed transmission by said motor at two winds and driving said spindle and traverse mechanisms starting at a wind of about 89 to about 152.52 and after about 0.1 to about 3 minutes changing to achieve a wind of from about 11 to about 17 driving said cam followers with a high speed double track cam with the tracks cut so that the cam followers will describe a path at the reversal along a 60° angular displacement of a curve of cycloidal development so that the wound up yarn can be unwound at speeds up to 3,000 feet per minute.

6. The method of claim 5 wherein said wind at the start is 152.51366 and after change the wind is 15.96380 with a lay of 0.1342 inches and a varying helix angle of from 9°42′ to 4°34′, after change.

* * * * *